United States Patent [19]

Goldstein et al.

[11] Patent Number: 4,590,401

[45] Date of Patent: May 20, 1986

[54] ION CHAMBER WITH A FLAT SENSITIVITY RESPONSE CHARACTERISTIC

[75] Inventors: Norman P. Goldstein, Murrysville, Pa.; Alex D. Service, Erin; William H. Todt, Elmira Heights, both of N.Y.

[73] Assignee: Westinghouse Electric Corp., Pittsburgh, Pa.

[21] Appl. No.: 469,869

[22] Filed: Feb. 25, 1983

[51] Int. Cl.[4] ..... H01J 47/02; H01J 47/08

[52] U.S. Cl. ..... 313/93; 313/538; 250/374

[58] Field of Search ..... 313/93, 643, 538, 539; 250/374, 423 P; 434/218

[56] References Cited

U.S. PATENT DOCUMENTS

| | | | |
|---|---|---|---|
| 3,092,747 | 6/1963 | Fine et al. | 313/93 |
| 3,098,944 | 7/1963 | Fox | 313/93 |
| 3,213,312 | 10/1965 | Crowe et al. | 313/538 X |
| 3,414,726 | 12/1968 | Chameroy | 313/93 X |
| 3,609,435 | 9/1971 | Taylor | 313/93 |
| 4,047,039 | 9/1977 | Houston | 313/93 X |

*Primary Examiner*—Palmer C. DeMeo
*Assistant Examiner*—Sandra L. O'Shea
*Attorney, Agent, or Firm*—W. G. Sutcliff

[57] ABSTRACT

An ion chamber exhibiting a flat response to a wide range of incident gamma energy is provided by a high-pressure fill gas mixture of a first major constituent, low atomic number gas which exhibits a reduced gamma response at low gamma energy levels, and a second minor constituent, high atomic number gas which exhibits an increased gamma response at low gamma energy levels. The preferred fill gas mixture is nitrogen as the major constituent and xenon as the minor constituent.

4 Claims, 2 Drawing Figures

ION CHAMBER WITH A FLAT SENSITIVITY RESPONSE CHARACTERISTIC

BACKGROUND OF THE INVENTION

The present invention relates to ion chamber radiation detectors in which an electrical current is generated in response to the radiation field of the surrounding environment. Such ion chambers rely upon the interaction of the incident radiation with the fill gas within the chamber to produce an electrical current through the gas between voltage biased electrodes. The electrical current produced is a function of the radiation impinging on the chamber. Ion chambers are widely used as radiation monitoring devices, for example in nuclear reactor containment environments.

It is desirable for detectors of this sort to have a response in amperes per roentgen per hour which is independent of the energy of the gamma-rays impinging on the chamber. If this is true then the chamber correctly indicates the health hazard associated with a gamma field regardless of the energy spectrum of the field. This is most easily achieved by use of air or tissue equivalent radiation monitoring chambers, which are constructed of low atomic weight organic materials to simulate either air or tissue.

In ion chambers designed for post-accident nuclear reactor environments, the ion chamber must be capable of withstanding intense radiation, high pressure, high temperature, and even corrosive chemical reactants. These conditions eliminate the use of organic materials for construction of the detector, and dictate that high temperature resistant metallic members be used. However, metal walled ion chambers do not exhibit the same energy independent response attained with air and tissue equivalent detectors. It has been found possible in prior art metal walled ion chamber designs to satisfy the energy independent requirement when the fill gas was maintained at approximately atmospheric pressure. Such low fill pressure ion chamber designs however suffer from reduced sensitivity. The most widely utilized fill gas in such ion chambers is nitrogen. The more sensitive, high fill pressure, metal walled ion chambers of the prior art typically utilize nitrogen gas at a fill pressure of up to about 10 atmospheres. Such high pressure, high sensitivity, walled ion chambers do not exhibit the requisite flat energy response characteristic. Recent regulations for such accident monitoring ion chambers call for an energy response which is flat within ±20% of the mean value. The high-pressure nitrogen fill gas ion chamber fails to meet this criteria because the response decreases significantly at low gamma ray energies.

It has generally been recognized that for many ion chamber designs having low atomic number gas fills, such as nitrogen, a decreased response characteristic is observed at low energies of the gamma radiation field. This is particularly true where metal walled thick electrode structures are utilized. It is also known that for ion chambers with high atomic number fill gases such as xenon, the signal response increases significantly at low gamma ray energies.

SUMMARY OF THE INVENTION

An ion chamber which exhibits a flat sensitivity response to a wide range of incident gamma energies is provided by a selected fill gas mixture of a first major constituent, low atomic number gas, which exhibits a reduced gamma response at low gamma energy levels, and a second minor constituent, high atomic number gas, which exhibits an increased gamma response at low gamma energy levels. The major constituent, low atomic number gas, is preferably nitrogen, and the high atomic number, minor constituent gas is preferably xenon. The fill gas mixture is present in the ion chamber at a pressure of about 10 atmospheres and the preferred volume ratio of nitrogen to xenon is about 97.75:2.25 for the embodiment described. The sensitivity of gamma response within a ±20% range is obtained over a range of incident gamma energy from about 0.1 MeV to 3 MeV. The low atomic number, major constituent fill gas is selected from the group of nitrogen, neon, argon, helium, and mixtures thereof. The high atomic number, minor constituent may be xenon and/or krypton. The volume percent of the minor constitutent may be up to about 15 volume percent of the total fill gas volume in achieving the desired flat response in other embodiments.

DESCRIPTION OF THE PREFERRED EMBODIMENTS

Figure 1:
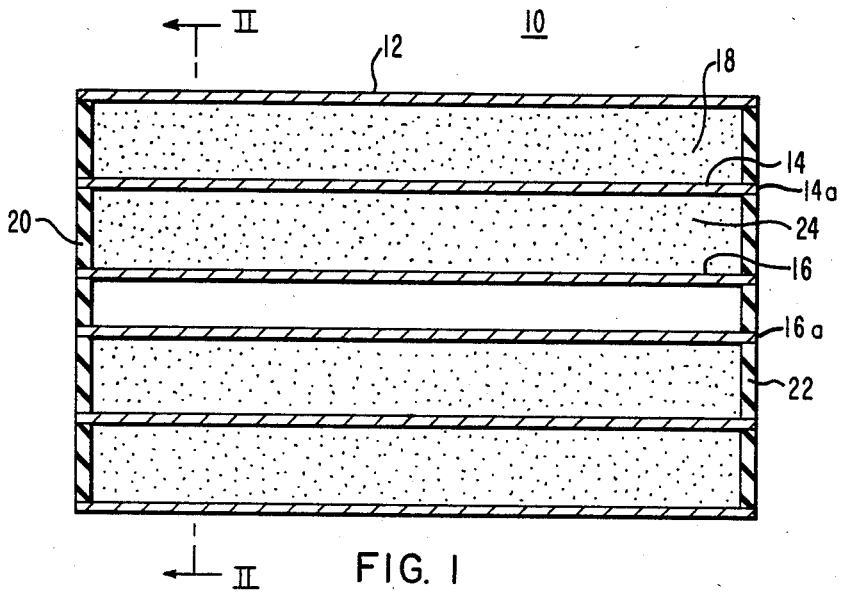
FIG. 1 is a side elevational sectional view of an ion chamber embodiment of the present invention.
Figure 2:
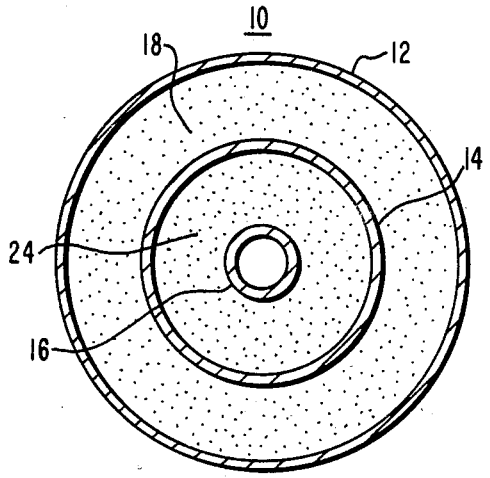
FIG. 2 is a view along line II—II of the embodiment of FIG. 1.

The present invention can be best understood by reference to the embodiment seen in FIGS. 1 and 2. The ion chamber 10 comprises a hermetically sealed, generally cylindrical outer electrode 12. A concentrically disposed first tubular electrode 14 is spaced within the volume defined by the outer electrode 12. A second tubular inner electrode 16 is disposed concentrically within the first electrode 14 and spaced therefrom. Suitable insulating hermetic end seals 20 and 22 are provided at opposed ends of the generally tubular electrode structures. The extending end 14*a* of first tubular electrode 14 extends through insulating hermetic end seal 20 to serve as an electrical lead-in. The extending end 16*a* of the second tubular electrode 16 extends through insulating hermetic end seal 22 to also serve as an electrical lead-in. The respective volume between electrode members 12 and 14 and between electrode 14 and 16 following evacuation are filled with a mixture of nitrogen and xenon at a pressure of about 10 atmospheres. The volume ratio of nitrogen to xenon is preferably about 97.75% nitrogen to 2.25% xenon.

A first gas-filled chamber 18 is defined between electrodes 12 and 14, while a second gas-filled chamber 24 is defined between electrodes 14 and 16.

The first tubular electrode 14 is biased at a high voltage, typically about 1,000 volts, relative to the outer electrode 12 and the second inner electrode 16, which are typically at ground potential, to provide two separate current collection zones with the total current or response being summed from these two chambers 18 and 24.

Table I below lists the calculated response characteristics of the ion chamber of the discussion over a gamma energy spectrum range of 0.088 MeV to 3 MeV and over a xenon fill gas percentage of about 1.5 volume percent to 6 volume percent with nitrogen as the remainder of the fill gas, and a 10 atmosphere total pressure. The calculated mixture which exhibits the flattest sensitivity response, well within the ±20% range required by recent regulations, is best achieved at a 2.25 volume percent xenon level. The first column of Table I lists a calculated response for the same chamber design with a 10 atmosphere fill gas of nitrogen, with the sensitivity varying widely over the range of incident gamma ray energies.

TABLE I

| Gamma Ray Energy (MeV) | 10 atm N | Sensitivity ($10^{-10}$ A/R/h) 1.5% Xe | 2.25% Xe | 3.0% Xe | 6.0% Xe |
|---|---|---|---|---|---|
| .088 | 0.65 ± .03 | 1.38 ± .08 | 1.65 ± .09 | 1.74 ± .10 | 2.75 ± .13 |
| .1 | 0.93 ± .03 | 1.62 ± .09 | 1.87 ± .10 | 1.92 ± .10 | 3.29 ± .14 |
| .15 | 1.20 ± .04 | 1.60 ± .11 | 1.73 ± .13 | 1.91 ± .12 | 2.66 ± .15 |
| .25 | 1.40 ± .05 | 1.69 ± .13 | 1.77 ± .13 | 1.76 ± .13 | 2.15 ± .16 |
| .35 | 1.33 ± .05 | 1.57 ± .11 | 1.70 ± .11 | 1.76 ± .11 | 1.86 ± .13 |
| .5 | 1.51 ± .05 | 1.63 ± .12 | 1.78 ± .13 | 1.84 ± .13 | 1.86 ± .13 |
| 1.2 | 1.66 ± .06 | 1.82 ± .10 | 1.85 ± .10 | 2.07 ± .12 | 2.20 ± .12 |
| 3.0 | 1.66 ± .07 | 1.93 ± .14 | 1.97 ± .14 | 2.08 ± .14 | 2.38 ± .16 |

The tubular outer electrode 12 can serve as the ion chamber envelope, and can be a relatively thick-walled stainless steel member, which is high-temperature and high-pressure resistant. The tubular inner electrodes 14 and 16, which are protected from the environment by the outer electrode or envelope, are typically thinner walled aluminum members.

The respective electrodes 12, 14, and 16 are adapted to be connected externally to high sensitivity current measuring means having a sensitivity in the range of about $10^{-10}$ amperes per roentgen per hour.

The calculated sensitivity for ion chambers of the present invention with the volume percentage of xenon varied from about 1.5% xenon to about 6% xenon is seen in Table I over a range of incident gamma energies from 0.088 to 3 MeV.

The specific details of the ion chamber structure can be changed. Thus, a single sensing chamber is all that is required between a pair of spaced-apart electrodes. The electrode materials can be varied. The teaching here is that a flat response to incident gamma energy over a wide range of gamma energy can be provided by a mixed fill gas, which comprises a low atomic number, first major constituent, such as nitrogen which has a reduced gamma response at low gamma energy. Other low atomic number gases which can be substituted for nitrogen in whole or in part are neon, argon, and helium. The second minor constituent, high atomic number gas may be xenon and/or krypton which both exhibit an increased response to low gamma energies. The high atomic number gas may be present in amounts up to about 15 volume percent of the total. For mixtures with higher volume percentages of the high atomic number gas, the gamma response of this higher atomic number gas will have a greater effect and the desired flat response would not be had. The ratio of the high atomic number gas and low atomic number gas which produces the flattest response depends upon the specific structure and fill gas pressure of the ion chamber design.

We claim:

1. An ion chamber which exhibits a flat response to a wide range of incident gamma energy levels, which ion chamber comprises a hermetically sealed chamber within which at least a pair of spaced apart electrodes are disposed, which electrodes have hermetically sealed electrical lead-ins through the chamber wall to permit electrical connection to a predetermined operating potential source and to current measuring means, which current is a function of the incident gamma radiation field, and wherein selected gamma radiation interactive fill gas fills the hermetically sealed chamber at a selected high pressure which provides a high sensitivity, and wherein the selected fill gas is a mixture of a first major constituent, low atomic number gas, which first major constituent is nitrogen and is present in at least 85 volume percent of the fill gas mixture and exhibits a reduced gamma response at low gamma energy levels, and a second minor constituent, high atomic number gas, which second minor constituent is xenon and is present in up to about 15 volume percent of the fill gas mixture and exhibits an increased gamma response at low gamma energy levels.

2. The ion chamber set forth in claim 1, wherein the volume ratio of nitrogen to xenon is preferably about 97.75:2.25.

3. The ion chamber set forth in claim 1, wherein the fill gas mixture is present within the ion chamber at a pressure of about 10 atmospheres.

4. The ion chamber set forth in claim 1, wherein the sensitivity of gamma response is within a ±20% range, over a range of incident gamma energy of from about 0.1 MeV to 3 MeV.

* * * * *